US005947682A

United States Patent [19]

Moon

[11] Patent Number: 5,947,682

[45] Date of Patent: Sep. 7, 1999

[54] PUMP HOUSING AND A MANUFACTURING METHOD THEREFOR

[75] Inventor: Sung-Dai Moon, Kyeonsangbook-Do, Rep. of Korea

[73] Assignee: Daewoo Electronics Co., Ltd., Seoul, Rep. of Korea

[21] Appl. No.: 08/700,956

[22] Filed: Aug. 21, 1996

[30] Foreign Application Priority Data

Dec. 9, 1995 [KR] Rep. of Korea ..... 95-48130

[51] Int. Cl.[6] ..... F01D 1/02

[52] U.S. Cl. ..... 415/200; 415/204; 415/206; 415/214.1; 415/215.1; 415/915

[58] Field of Search ..... 415/200, 203, 415/204, 206, 214.1, 215.1, 915; 264/263, 250, 328.8; 164/94, 95, 96

[56] References Cited

U.S. PATENT DOCUMENTS 3,412,721 11/1968 Thompson ..... 164/94

4,179,238 12/1979 Ashworth ..... 415/197

5,756,029 5/1998 Nakamichi et al. ..... 264/161

*Primary Examiner*—F. Daniel Lopez

*Assistant Examiner*—Ninh Nguyen

*Attorney, Agent, or Firm*—Nixon & Vanderhy P.C.

[57] ABSTRACT

A pump housing and manufacturing method therefor includes a primary molding for injecting halves of the pump housing and a secondary molding for assembling the primary molds to each other to be installed to the interior of a secondary metal mold and secondarily-molding the outer surface of the pump housing without requiring core fabrication, installation and removal steps of the injection molding. Thus, the core fabrication and core removal steps heretofore required for an inlet or undercut are unnecessary for enabling swift mass production and lowering difficulty of working to make the quality consistent and decrease inferior products, thereby reducing the manufacturing cost.

8 Claims, 6 Drawing Sheets

PUMP HOUSING AND A MANUFACTURING METHOD THEREFOR

BACKGROUND OF THE INVENTION

1. Field of the Invention

The present invention relates to a pump housing and manufacturing method therefor, and more particularly to a pump housing and manufacturing method therefor, wherein a molding process of a pump housing for circulating hot water is separated into a primary molding and a second molding for improving quality of a product and reducing manufacturing Cost.

2. Description of the Prior Art

A pump housing of a hot-water circulating pump molded via a conventional molding method is illustrated in FIGS. 1 and 2. FIG. 1 is a plan view showing the pump housing, and FIG. 2 is a sectional view thereof.

As shown in FIGS. 1 and 2, pump housing 10 has an inlet 15 for admitting a fluid, and a volute chamber 11 formed for facilitating the flowing of the admitted fluid and constantly maintaining the sum of ordinary flow rate components and an outlet 13 for discharging the admitted fluid. A whirlpool-type spiral groove 17 is formed within volute chamber 11. The pump housing 10 cannot be formed by a single injection molding process due to the shape of spiral groove 17 and the streamlined structure of the inlet 15 and outlet 13. Therefore, a core which is a hollow bar of a metal mold is employed to perform the molding, and then removed after the molding.

FIG. 3 illustrates a process for manufacturing pump housing 10 via the conventional molding method. Referring to FIG. 3, a metal mold fabricating step for forming a metal mold having the outer surface shape of pump housing 10 and a core fabricating step for forming a core constituting the interior of inlet 15, outlet 13 and volute chamber 11 should be executed in advance.

After finishing the above steps, a core installing step for installing the core within the fabricated metal mold, and an injection molding step are sequentially carried out. After the injection molding, pump housing 10 is separated from the metal mold, and a core removing step of eliminating the core within pump housing 10 is then executed. Thus, the molding process of pump housing 10 is completed to produce completed pump housing 10.

The core removing process is different depending upon the type of core being used. That is, a lost core for removing the core after injection-molding pump housing 10 is classified into a casting sand lost core which uses casting sand during a casting for pulverizing to remove the core after the injection molding and a messed lost core which injects an alloy of lead and bismuth during the injection molding for melting to remove the alloy after the injection molding.

The molding method of the pump housing using the lost core involves steps of the metal mold fabrication, core fabrication, core installation, injection molding and core removal to require relatively lengthy processing. In particular, the removal step has drawbacks since this step require a long time to be completed and also requires a highly skilled worker.

That is, with regard to the injection molding, the messed is a lead-bismuth alloy in which heat is applied in order to remove the alloy after the injection molding. This process result in much time and labor so the operation is costly. Due to the aforesaid drawback, injection molding is only applied to special use products rather than general use products.

Also, in case of the casting, the casting sand lost core is broken or pulverized to be removed after the casting. Thus, so much time is required and the working is difficulty.

Additionally, in overall molding process, the lost core installed to the metal mold is liable to be shaken while a liquid metal is poured to be forced out or inclined toward one side. Particularly, the casting is disadvantageous in that the lost core is moved while the casting sand is broken down. Furthermore, in spite that a core bar is inserted into the core for preventing the warping of the lost core, the lost core is warped to be deformed owing to the high temperature of the liquid metal which in turn results in a defect of products.

SUMMARY OF THE INVENTION

It is an object of the present invention to provide a pump housing and manufacturing method therefor, wherein, in order to solve the foregoing problems, a molding process is classified into a primary molding and a secondary molding for improving quality of products and simplifying and facilitating a manufacturing process thereof.

To achieve the above object of the present invention, a pump housing includes a left molded member which is one half of a primary molded member formed with an inlet for admitting a fluid in one side, a volute chamber communicated with the inlet at the center and an outlet for discharging the fluid in a portion opposing to the inlet. A right molded member which is the other half of the primary molded member united with the section of the left molded member for forming an internal space of the inlet, outlet and volute chamber. Also, a secondary molded member is injection-molded to the outer surface of the united left molded member and right molded member.

Here, it is preferable that a spiral groove connected to the outlet for facilitating flowing of the fluid is formed in an inner wall of the volute chamber, and a plurality of projections for preventing the floating during the injection-molding of the secondary molded member are formed to the outer surface of the primary molded member.

In addition, a plurality of grooves may be formed in the outer surface of the primary molded member for smoothly depositing a liquid of the secondary molded member.

Preferably, a junction portion of the left molded member and right molded member is provided to be formed with a guide projection at one junction end and a guide groove coupled with the guide projection in the other junction end for blocking intrusion of the liquid of the secondary molded member into the primary molded member.

Alternatively, to achieve the above object of the present invention, a pump housing includes a left molded member being one half of a primary molded member formed with an inlet for admitting a fluid in one side, a volute chamber communicated with the inlet at the center and an outlet for discharging the fluid in a portion opposing to the inlet. A right molded member being the other halt the primary molded member is united with the section of the left molded member for forming an internal space of the inlet, outlet and volute chamber, and a spiral groove is connected to the outlet in the inner wall of the volute chamber for facilitating the flowing of the fluid. The outer surface of the united left molded member and right molded member is injection-molded with a secondary molded member, and a plurality of projections are provided from an outer surface of the primary molded member for preventing the floating thereof during the injection-molding of the secondary molded member. A plurality of grooves formed in the outer surface of the primary molded member facilitate the flow of a liquid of the secondary molded member. Furthermore, a guide projection is formed to one junction end around a junction portion of the left molded member and right molded member for blocking intrusion of the liquid of the secondary molded member into the interior of the primary molded member. Then, a guide groove formed to the other junction end is fitted with the guide projection To achieve the above and other object of the present invention, a method for manufacturing the pump housing is sequentially performed by preparing respective metal molds for injection-molding portions of a primary molded member formed with an inlet for admitting a fluid in one side, a volute chamber communicated with the inlet at the center and an outlet in the opposing side of the inlet for discharging the fluid, and preparing a metal mold of a secondary molded member injection-molded to an outer surface of the primary molded member. Thereafter, the primary molded member is molded and the secondary molded member is molded.

Here, the step of preparing the metal mold of the primary molded member is preferably performed by preparing the metal mold of the left molded member of the primary molded member, and preparing the metal mold of the right molded member being the other half of the primary molded member united with the section of the left molded member for forming the internal space of the inlet, outlet and volute chamber.

More preferably, the step of molding the secondary molded member is conducted such that the left molded member is united with the right molded member, the united primary molded member is installed to the interior of the metal mold of the secondary molded member, and performing the injection into a clearance between the interior of the metal mold of the secondary molded member and primary molded member.

The pump housing according to the present invention described as above is formed by the primary molded member functioning as a core and the secondary molded member molded to the outer surface of the primary molded member to be provided as one body.

The primary molded member is constructed by the left molded member and right molded member having the vertically-cut section of the inlet, outlet and volute chamber. That is, the left molded member is shaped as the left side and the right molded member is shaped as the right side when the center of the pump housing is vertically cut through. The left molded member and right molded member are separately provided from respective metal molds to be assembled with each other, thereby serving as the core of the secondary molded member.

The secondary molded member is injection-molded to the outer surface of the primary molded member as described above to unite the assembled primary molded member not to be separated from each other while constituting the outer appearance of the pump housing.

Additionally, the method for manufacturing the pump housing according to the present invention constructed as above can be largely classified into the step of molding the pair of primary molded members and the step of molding the secondary molded member by using the primary molded members as the core.

The step for molding the primary molded member is carried out by fabricating the metal molds of the left molded member and right molded member respectively constituting the vertical halves of the pump housing, and molding them by using the metal molds.

The step for molding the secondary molded member is carried out by fabricating the metal mold of the secondary molded member, and insertedly installing the pair of primary molded member into the metal mold of the secondary molded member and performing the final molding, thereby completing the pump housing.

Therefore, the pump housing and manufacturing method therefor according to the present invention constructed as above can prevent the shaking of the primary molded member caused by the pressure of the liquid poured in the molding step of the secondary molded member, and prevent the intrusion of the poured liquid into the interior of the primary molded member.

Also, the core fabrication and core removal steps heretofore needed for an inlet or undercut are not required for enabling speedy mass production and lowering the difficulty in working to make the quality consistent and decrease inferior products, thereby reducing the manufacturing cost.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENTS

A pump housing and manufacturing method therefor according to the present invention will be described in detail with reference to accompanying drawings.

Figure 1:
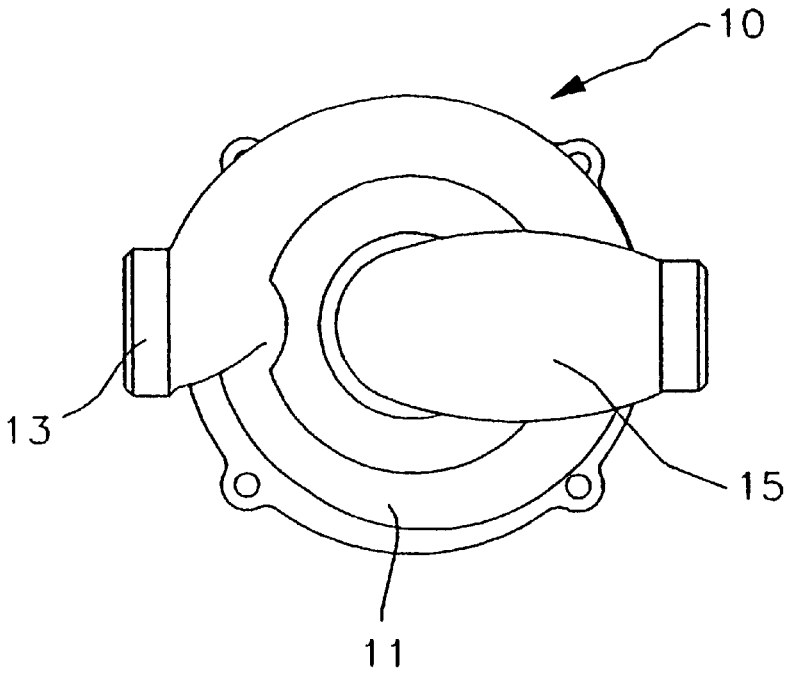
FIG. 1 PRIOR ART
FIG. 1 is a plan view showing a pump housing molded by means of a conventional molding method.
Figure 2:
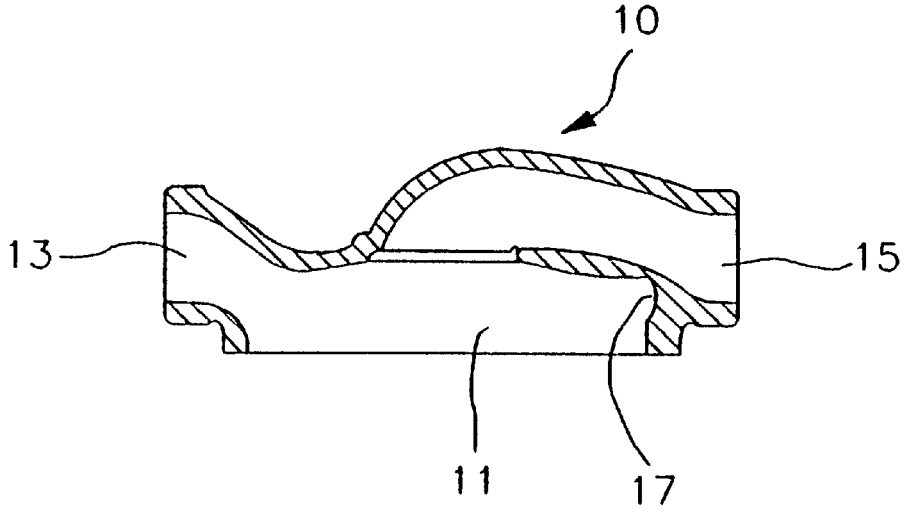
FIG. 2 PRIOR ART
FIG. 2 is a sectional view of the pump housing shown in FIG. 1.
Figure 3:
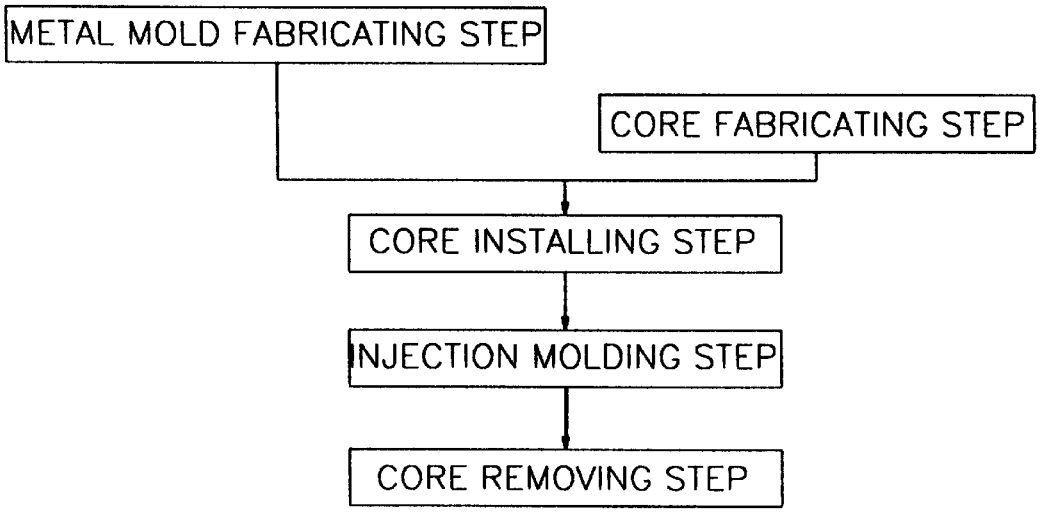
FIG.3 PRIOR ART
FIG. 3 shows a process of manufacturing the pump housing according to the conventional molding method.
Figure 4:
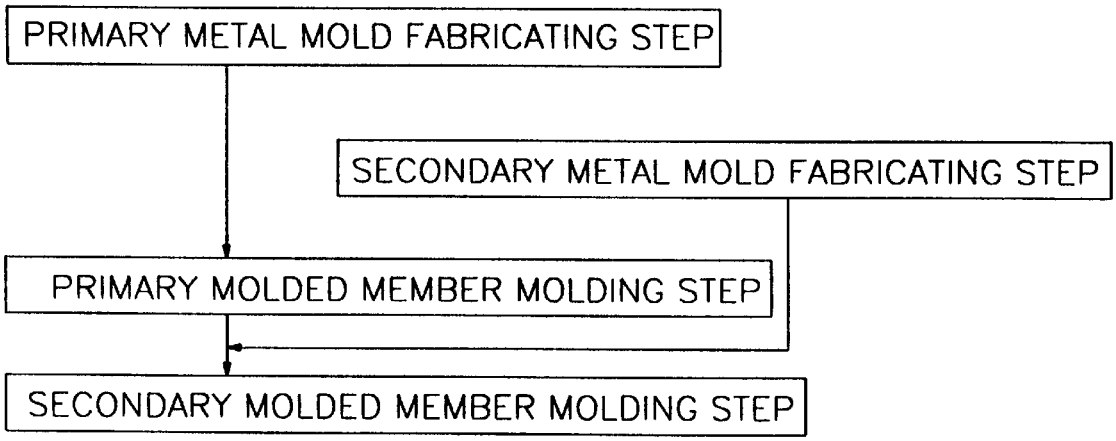
FIG. 4 shows a process of manufacturing a pump housing by means of a molding method according to the present invention.

FIG. 4 illustrates a process for manufacturing the pump housing according to a molding method of the present invention. Referring to FIG. 4, a step for fabricating a metal mold of a primary molded member (hereinafter simply referred to as "primary metal mold") directs a step for fabricating the metal mold for molding half the pump housing with respect to the longitudinal direction. Then, a step for fabricating a metal mold of a secondary molded member (hereinafter simply referred to as "secondary metal mold") is for fabricating a metal mold constituting the outer appearance of the pump housing by being formed to the outer surface of the primary molded member.

A molding of the primary molded member refers a step of molding the primary molded member, i.e., a left molded member and right molded member, by using the primary metal mold. Thereafter, the left molded member and right molded member are brought into contact with each other to be assembled. The assembled molds are inserted to be fixed to the interior of the secondary metal mold.

A molding of the secondary molded member refers a step of completely finishing the pump housing by pouring a liquid between the secondary metal mold and primary molded member.

Figure 5:
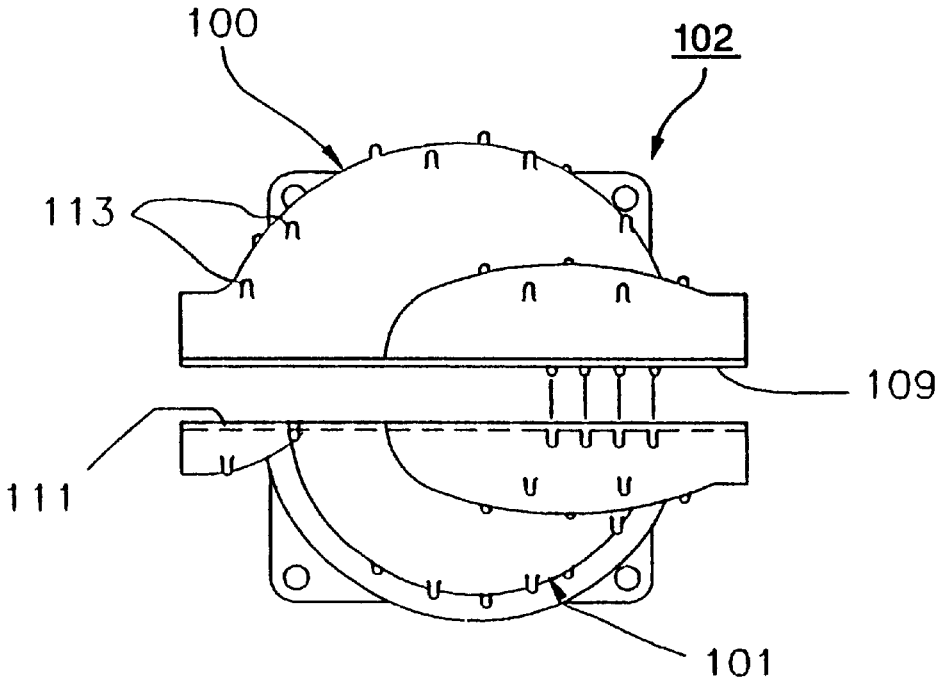
FIG. 5 in a plan view showing a pair of primary molded members in the pump housing according to the present invention.

FIG. 5 is a plan view showing the pair of primary molded members of the pump housing according to the present invention. Referring to FIG. 5, primary molded member 102 consists of left molded member 100 and right molded member 101.

Left molded member 100 is formed with a guide projection 109 at a portion in contact with right molded member 101, and a guide groove 111 is formed in a corresponding portion of right molded member 101 to be fitted with guide projection 109. When left molded member 100 and right molded member 101 are assembled by being engaged with each other in this manner, the internal room of pump housing 300, i.e., an inlet, an outlet and a volute chamber, is completed.

A plurality of projections 113 protrude from the outer surface of left molded member 100 and right molded member 101 for preventing the floating of primary molded member 102 in the secondary molding step. It is good enough for projections 113 to have a predetermined projecting height and place on the outer surface without being greatly spaced apart from one another.

Figure 6:
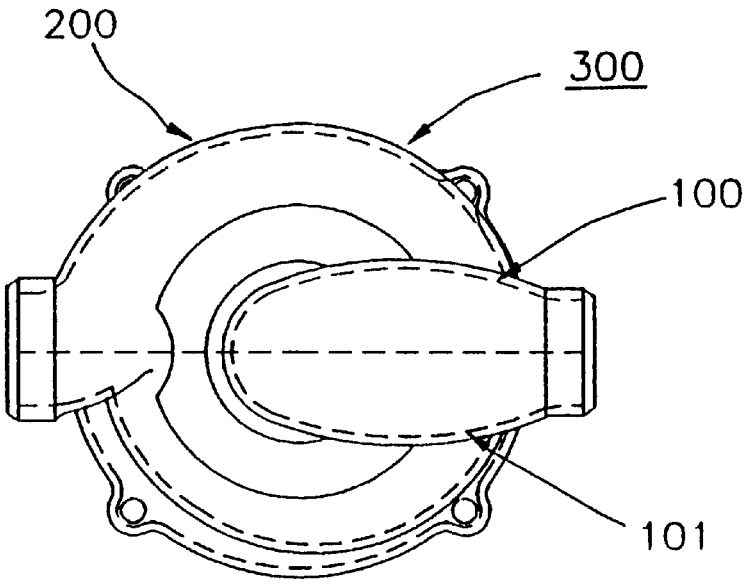
FIG. 6 is a plan view showing a secondary molded member in the pump housing according to the present invention.

FIG. 6 is a plan view showing the secondary molded member of the pump housing according to the present invention. Referring to FIG. 6, secondary molded member 200 having a predetermined thickness is formed to the outer surface of assembled left molded member 100 and right molded member 101 to constitute pump housing 300.

Figure 7:
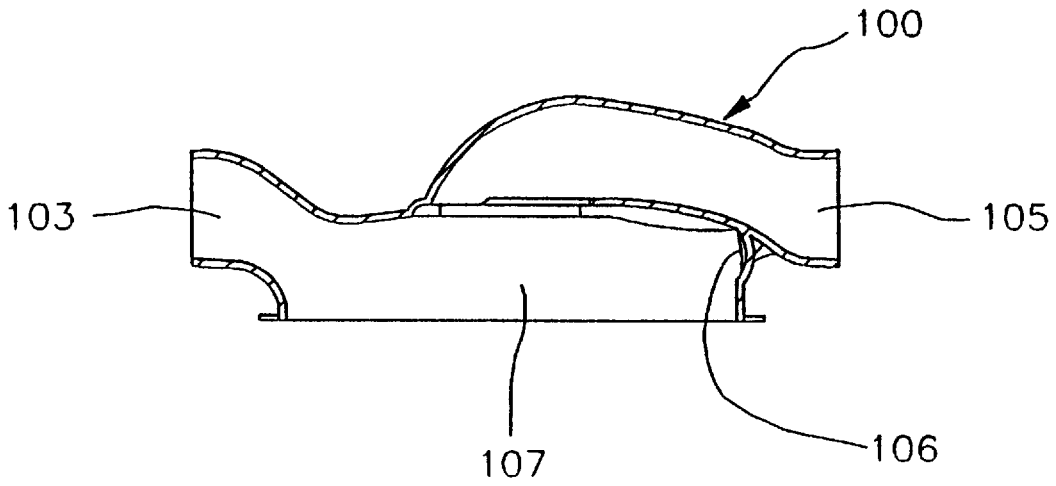
FIG. 7 is a sectional view showing the left molded member of the primary molded member shown in FIG. 5.

FIG. 7 is a sectional view showing left molded member 100 of primary molded member 102 shown in FIG. 5. That is, FIG. 7 illustrates the formation and connection of a flow passage forming the interior of pump housing 300.

In FIG. 7, inlet 105 for admitting hot water is formed to the right side, and volute chamber 107 having an upper portion connected to inlet 105 is formed to the central portion. A spiral groove 106 for facilitating the flow of the hot water is formed in the sidewall of volute chamber 107. Outlet 103 for discharging the hot water is formed to the last portion of spiral groove 106. Volute chamber 107 serves for smoothing the flow of the hot water and making the sum of ordinary flow rate components constant. The bottom of volute chamber 107 is open to be communicated with an interior of a pump when pump housing 300 is coupled to a body (not shown) of the pump.

Figure 8:
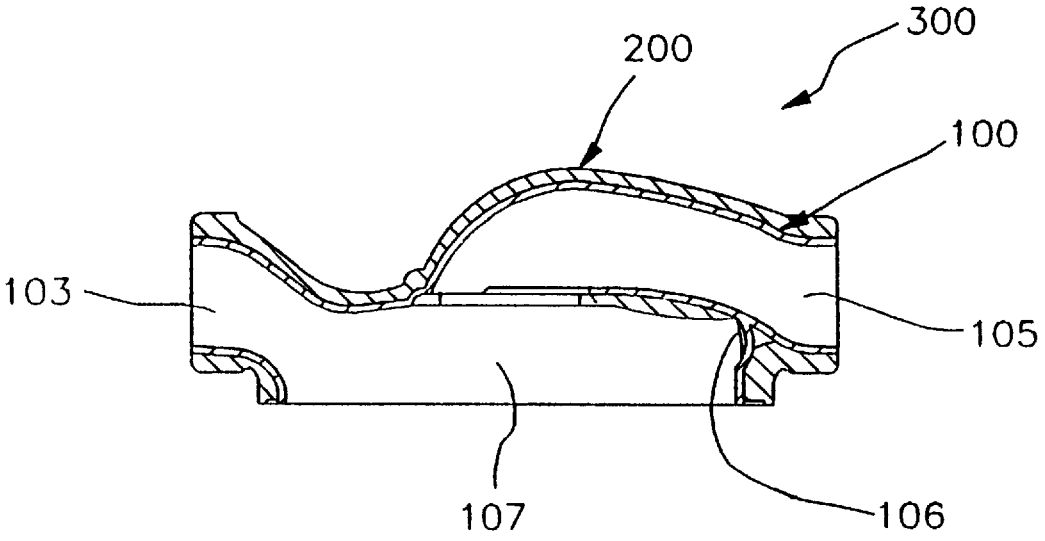
FIG. 8 is a sectional view of the pump housing shown in FIG. 6.

FIG. 8 is a sectional view of pump housing 300 shown in FIG. 6. As shown in FIG. 8. secondary molded member 200 having a predetermined thickness is injection molded to the outer surface of left molded member 100. In other words, secondary molded member 200 is formed to left molded member 100, thereby completing pump housing 300.

Figure 9:
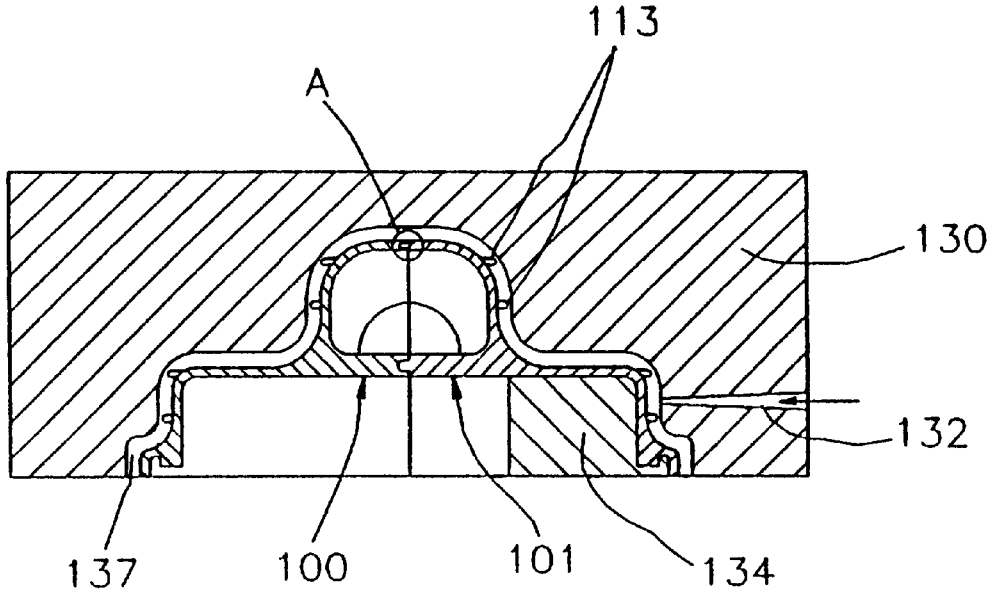
FIG. 9 is a sectional view showing a state that the primary molded member having projections is installed to the metal mold of the secondary molded member according to a first embodiment of the present invention.

FIG. 9 shows a first embodiment of the present invention which illustrates a state that the primary molded member having projections 113 is installed to secondary metal mold 130. As shown in FIG. 9. secondary metal mold 130 is fabricated to mold the outer appearance of pump housing 300, and the interior thereof is provided for being inserted with pair of left molded member 100 and right molded member 101 which are assembled by being brought into contact with each other.

A prescribed clearance 137 is formed between secondary metal mold 130 and primary molded member 100 & 101 for being admitted with the liquid of secondary molded member 200. Plurality of projections 113 directing toward secondary metal mold 130 are formed from the outer surface of primary molded member 100 & 101.

An ingate 132 for supplying the liquid into clearance 137 is installed into secondary metal mold 130. Ingate 132 may number one or at least two in accordance with the size and injection conditions of pump housing 300.

When the liquid of secondary molded member 200 is poured after left molded member 100 and right molded member 101 are installed to the interior of secondary metal mold 130, left molded member 100 and right molded member 101 are liable to be shaken by the pouring amount of the liquid. For preventing the shaking, an auxiliary metal mold 134 is fixedly installed to the rear plane of ingate 132 within left molded member 100 or right molded member 101.

Figure 10:
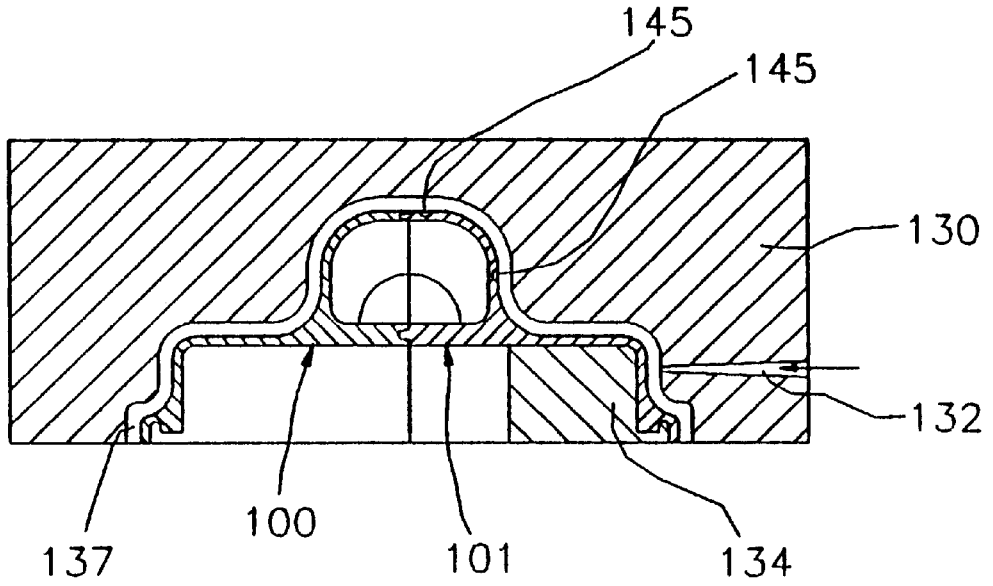
FIG. 10 is a sectional view showing a state that the primary molded member having grooves is installed to the metal mold of the secondary molded member according to a second embodiment of the present invention.

FIG. 10 which illustrates a secondary embodiment of the present invention is a sectional view showing a state that primary molded member 100 & 101 having grooves 145 is installed to secondary metal mold 130. As shown in FIG. 10, secondary metal mold 130 and auxiliary metal mold 134 are the same as those shown in FIG. 9 except that projections 113 are not formed to the outer surface of left molded member 100 and right molded member 101 but plurality of grooves 145 are provided. Grooves 145 serve for receiving the liquid along them to facilitate depositing of secondary molded member 200 to primary molded member 102.

Figure 11:
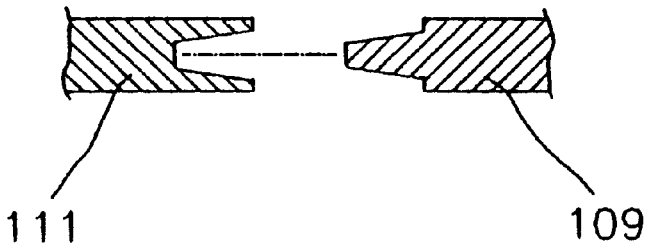
FIG. 11 is an enlarged view with respect to an A portion shown in FIG. 9.

FIG. 11 illustrates an enlarged sectional view with respect to a portion A of FIG. 9. As shown in FIG. 11, left molded member 100 is formed with guide groove 111 in the portion in contact with right molded member 101, and guide projection 109 is formed to the corresponding portion of right mold 101. Guide projection 109 and guide groove 111 are closely united with each other without involving any gap to block the intrusion of the liquid metal into the interior of primary molded member 102.

Figure 12:
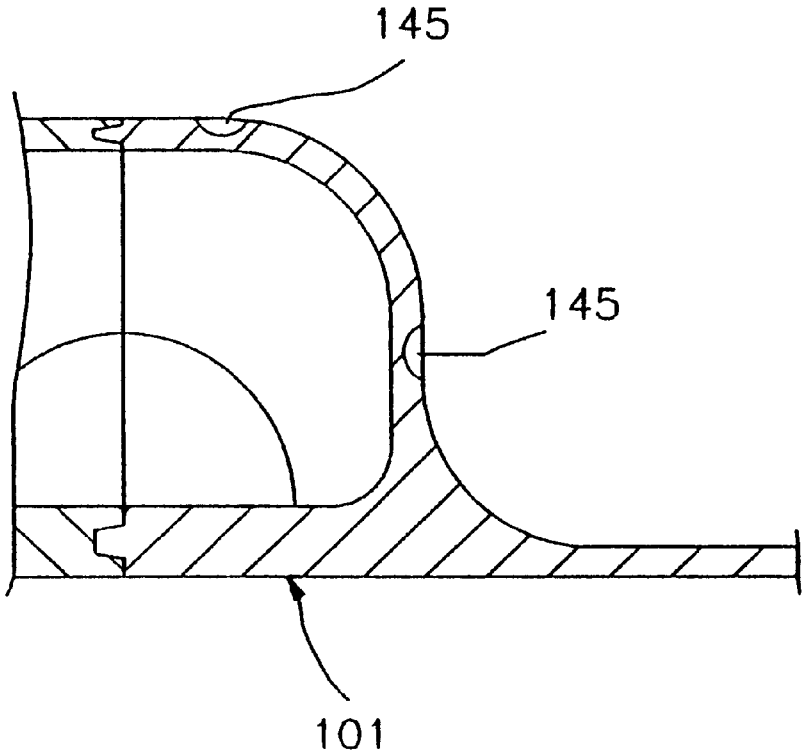
FIG. 12 is an enlarged view with respect to the groove portion shown in FIG. 10.

FIG. 12 illustrates an enlarged sectional view with respect to the groove portion of FIG. 10. Here, respective grooves 145 are engraved to have a predetermined depth within a range of not piercing through the thickness of primary molded member 102. Grooves 145 are consistently distributed across the outer surface of primary molded member 102, and, as required, may be formed to the outer surface of primary molded member 102 formed with projections 113.

In the pump housing and manufacturing method therefor according to the present invention constructed as above, the primary metal mold is fabricated, and the pair of left molded member 100 and right molded member 101 are injection-molded by the primary metal mold. Left molded member 100 and right molded member 101 are assembled by bringing guide groove 111 into contact with guide projection 109, which is insertedly installed to the interior of secondary metal mold 130. Thereafter, auxiliary metal mold 134 is fixed to the interior of primary molded member 102. Then, once the liquid is poured through ingate 132, the poured liquid is solidified while thoroughly filling up clearance 137 between secondary metal mold 130 and primary molded member 102. At this time, auxiliary metal mold 134 prevents the floating of primary molded member 102 due to the pressure of the liquid.

When secondary molded member 200 is hardened to be solidified, auxiliary metal mold 134 is separated and pump housing 300 is separately detached from the interior of secondary metal mold 130. By doing so, the final pump housing 300 is obtained Meantime, the substance of the liquid poured during the secondary molding is the same as primary molded member 102 to raise the affinity between primary molded member 102 and secondary molded member 200.

As a result, in the pump housing and manufacturing method therefor according to the present invention provided as above, the shaking of the primary molded member caused by the pressure of the liquid poured during the molding of the secondary molded member can be prevented while blocking the intrusion of the poured liquid into the interior of the primary molded member.

Furthermore, the core fabrication or core removal steps required for the inlet or undercut are unnecessary for enabling swift mass production and lowering the difficulty in working to make the quality consistent and decrease inferior products, thereby reducing the manufacturing cost.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. A pump housing comprising:

a left molded member being one half of a primary molded member formed with an inlet for admitting a fluid in one side, a volute chamber communicated with said inlet at the center and an outlet for discharging said fluid in a portion opposing to said inlet;

a right molded member being the other half of said primary molded member united with the section of said left molded member for forming an internal space of said inlet, outlet and volute chamber; and a secondary molded member injection-molded to the outer surface of the united left molded member and right molded member.

2. The pump housing as claimed in claim 1, wherein a spiral groove connected to said outlet for facilitating flowing of said fluid is formed in an inner wall of said volute chamber.

3. The pump housing as claimed in claim 1, wherein a plurality of projections for preventing the floating during the injection-molding of said secondary molded member are formed to the outer surface of said primary molded member.

4. The pump housing as claimed in claim 1, wherein a plurality of grooves are formed in the outer surface of said primary molded member for depositing a liquid of said secondary molded member.

5. The pump housing as claimed in claim 1, wherein a junction portion of said molded member and right molded member is provided to be formed with a guide projection at one junction end and a guide groove coupled with said guide projection in the other junction end for blocking intrusion of said liquid of said secondary molded member into said primary molded member.

6. A pump housing comprising:

a left molded member being one half of a primary molded member formed with an inlet for admitting a fluid in one side, a volute chamber communicated with said inlet at the center and an outlet for discharging said fluid in a portion opposing to said inlet;

a right molded member being the other half of said primary molded member united with the section of said left molded member for forming an internal space of said inlet, outlet and volute chamber;

a spiral groove connected to said outlet in the inner wall of said volute chamber for facilitating the flowing of said fluid;

a secondary molded member injection-molded to the outer surface of said united left molded member and right molded member;

a plurality of projections from an outer surface of said primary molded member for preventing the floating thereof during the injection-molding of said secondary molded member;

a plurality of grooves formed in said outer surface of said primary molded member for facilitating the flow of a liquid of said secondary molded member;

a guide projection formed to one junction end around a junction portion of said left molded member and right molded member for blocking intrusion of said liquid of said secondary molded member into the interior of said primary molded member; and a guide groove formed to the other junction end for being fitted with said guide projection.

7. A method for manufacturing a pump housing comprising the steps of:

preparing respective metal molds for injection-molding portions of a primary molded member formed with an inlet for admitting a fluid in one side, a volute chamber communicated with said inlet at the center and an outlet in the opposing side of said inlet for discharging said fluid;

preparing a metal mold of a secondary molded member injection-molded to an outer surface of said primary molded member;

molding said primary molded member; and molding said secondary molded member.

8. The method for manufacturing a pump housing as claimed in claim 7, wherein said step of preparing said metal mold of said primary molded member comprising the steps of:

preparing a metal mold of a left molded member of said primary molded member; and preparing a metal mold of a right molded member being the other half of said primary molded member united with the section of said left molded member for forming the internal space of said inlet, said outlet and said volute chamber.

* * * * *